United States Patent [19]

Schmidt, Sr. et al.

[11] 4,081,977

[45] Apr. 4, 1978

[54] DE-FLESHING APPARATUS FOR ANIMAL HIDES

[75] Inventors: Alexander Schmidt, Sr.; Walter Schmidt; Alexander Schmidt, Jr., all of Weiz, Austria

[73] Assignee: USM Corporation, Boston, Mass.

[21] Appl. No.: 806,200

[22] Filed: Jun. 13, 1977

Related U.S. Application Data

[63] Continuation of Ser. No. 714,275, Aug. 13, 1976, abandoned.

[30] Foreign Application Priority Data

Aug. 14, 1975 Austria ..... 6372/75

[51] Int. Cl.[2] ..... C14B 1/10

[52] U.S. Cl. ..... 69/42

[58] Field of Search ..... 69/42, 41

[56] References Cited

U.S. PATENT DOCUMENTS

| | | | |
|---|---|---|---|
| 1,869,472 | 8/1932 | Freudenberg | 69/42 |
| 2,686,415 | 8/1954 | Griffin | 69/41 |
| 2,704,932 | 3/1955 | McIlvin et al. | 69/42 X |
| 3,552,157 | 1/1971 | Repetto | 69/42 |
| 3,636,737 | 1/1972 | Schwaller et al. | 69/42 |
| 3,879,967 | 4/1975 | Repetto | 69/42 |

FOREIGN PATENT DOCUMENTS

| | | | |
|---|---|---|---|
| A80,654 | 4/1963 | France | 69/42 |
| 626,637 | 10/1961 | Italy | 69/42 |

*Primary Examiner*—Alfred R. Guest

*Attorney, Agent, or Firm*—Donald N. Halgren; Richard B. Megley; Vincent A. White

[57] ABSTRACT

De-fleshing apparatus comprises two fleshing machines arranged face-to-face, with a transfer conveyor between the machines. The conveyor is reversibly driven, and is arranged so that by movement in one direction a hide is transported from a first of the two machines to the second machine, half the hide having been de-fleshed in the first machine, and by movement in the opposite direction the hide is transported from the second machine as the other half of the hide is de-fleshed in the second movement. Each machine comprises a feed roller arranged to assist in drawing the hide through the machine while a cutter operates to de-flesh the hide, and the conveyor comprises an endless band which is mounted on the two feed rollers and driven thereby along its length in each direction.

1 Claim, 1 Drawing Figure

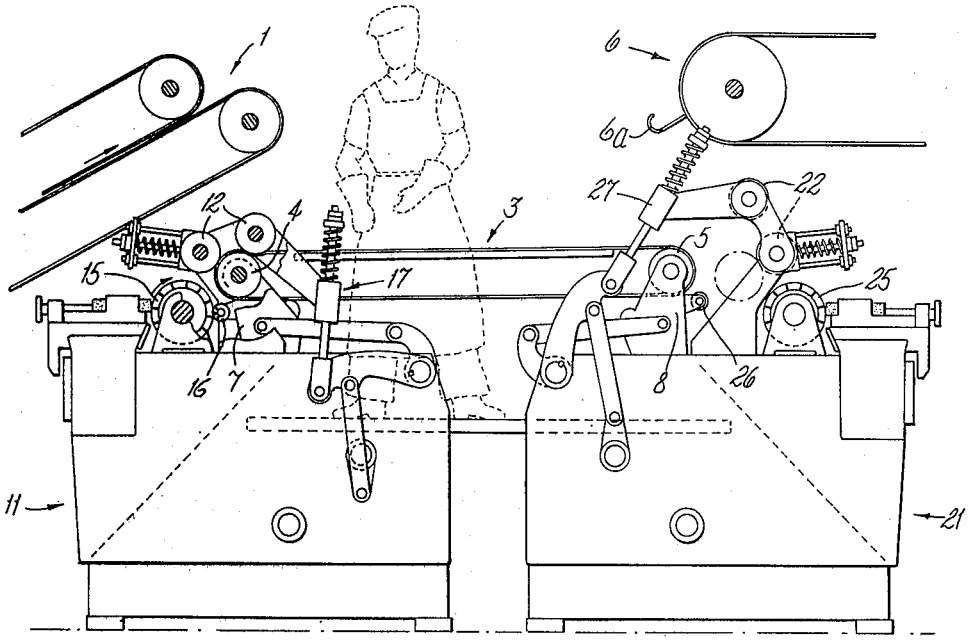
1
6
6a
27
22
12
4
3
5
15
17
25
16
7
8
26
11
21

DE-FLESHING APPARATUS FOR ANIMAL HIDES

This is a continuation, of application Ser. No. 714,275, filed Aug. 13, 1976 now abandoned.

BACKGROUND OF THE INVENTION

Fleshing machines for removing residual matter from the flesh side of animal skins and hides (referred to herein as de-fleshing) are well known. Commonly hides are de-fleshed in the machines in two stages, approximately half the hide being de-fleshed in each stage; for example, the hide may be introduced tail-end foremost for half of its length, the tail-end half of the hide being de-fleshed as the hide is then withdrawn from the machine, and the other half of the hide next introduced into the machine neck-end foremost for de-fleshing of the neck-end half of the hide. The manipulation of wet hides of large animals is, however, heavy and messy work, and accordingly the turning round of the hides between the two stages of de-fleshing, for introduction of the second half of the hide into the machine, is laborious and unpleasant for the operator.

To reduce the work of the operator it has been proposed to provide two machines and a conveyor which automatically feeds a hide from one machine, in which half the hide has been de-fleshed, into the other machine in which the other half of the hide is then de-fleshed, as shown in U.S. Pat. No. 3,552,157. However, not only is this arrangement fully automatic in operation, which precludes the ability to attend to the hide on passage from one machine to another, but also it is of somewhat complex construction.

SUMMARY OF THE INVENTION

According to the invention, a de-fleshing apparatus comprises two conventional fleshing machines which are arranged face-to-face (i.e. with the input side of each machine, on which side the operator would stand to use the machine if the machines were being used singly, facing the input side of the other machine), and a transfer conveyor which links the two machines and is arranged to transport a hide from one machine to the other, so that a hide is taken (after de-fleshing of half the hide) from a first of the two machines and fed into the second machine. Drive means of the conveyor is reversible so that the conveyor can be moved in one direction to transport a hide from the first machine, in which substantially half the hide is de-fleshed, and to feed the hide into the second machine, and can be moved in the opposite direction to transport the hide from the second machine, in which the other half of the hide is de-fleshed. Each machine comprises a rotatable feed roller arranged to assist in drawing a hide through the machine while a cutter operates to de-flesh half of the hide, and in a preferred arrangement the drive means of the conveyor comprises the two feed rollers, the conveyor comprising an endless band mounted on the two feed rollers.

There now follows a detailed description, to be read with reference to the accompanying drawing, of a de-fleshing apparatus which is a preferred embodiment of the invention. It should be understood that this illustrative apparatus has been selected for description to illustrate the invention by way of example and not by way of limitation.

BRIEF DESCRIPTION OF THE DRAWINGS

The drawing shows the illustrative apparatus in side elevation and partly in section.

DESCRIPTION OF THE PREFERRED EMBODIMENT

The illustrative apparatus comprises two fleshing machines 11 and 21 which are arranged face-to-face (i.e. with their input sides facing one another). A feed conveyor 1 is arranged to deliver hides from above to a first machine 11 of the two machines, and a delivery conveyor 6 is arranged for removal of the de-fleshed hides after processing in the second machine 21.

Each machine comprises a rotary cutter 15,25 against which a hide can be pressed by a pressure roll 16,26. The pressure roll 16,26 is mounted on a feed roller assembly 7,8 which comprises a rotatable feed roller 4,5; the feed roller assembly 7,8 is pivotally mounted for movement between an open position (as is shown in the drawing in respect of the second machine 21) in which the feed roller and the pressure roll are spaced-apart from the cutter, and a closed position (as is shown in the drawing in respect of the first machine 11) in which the feed roller and the pressure roll are positioned adjacent the cutter and the feed roller 4,5 is driven from the main drive of the machine. Mounted on the two feed rollers 4,5 to link the two machines is an endless band of a reversible transfer conveyor 3; the band is arranged to be driven along its length in either direction by the feed rollers 4,5. Each machine also comprises a grip roll assembly comprising a pair of rotatable grip rolls 12,22. Grip mechanism 17,27 is provided for swinging the pair of grip rolls 12,22 into and out of a driving position in which the rolls co-operate with the feed roller 4,5 to trap a hide when the feed roller assembly 7,8 is in its closed position.

In operation of the illustrative apparatus a hide is fed, tail-end foremost, by the feed conveyor 1 down into the first machine 11. The hide is guided for approximately half of its length through the gap between the cutter 15 and the pressure roll 16 (the feed roller assembly 7 being in its open position). The feed roller assembly 7 is then pivoted into its closed position and the grip rolls 12 are swung by the grip mechanism 17 into their driving position. Approximately half the hide now extends from between the cutter 15 and the pressure roll 16, between the feed roller 4 and the grip rolls 12, and on to the transfer conveyor 3, and the other half (with its flesh side towards the cutter 15) extends from the cutter 15 downwards, and the feed roller 4 and the grip rolls 12 are rotatably driven to draw the lower half of the hide up between the cutter 15 and the pressure roll 16, the cutter being rotated to de-flesh the hide. The hide, neck-end and foremost and flesh side upwards, is delivered by the transfer conveyor 3 from the first machine 11 into the second machine 21 (in which the feed roller assembly 8 is in its open position).

The hide is fed into the second machine 21 through the gap between the pressure roll 26 and the cutter 25 until the half of the hide which has not been de-fleshed extends downwards from the cutter 25. The feed roller assembly 7 of the first machine is then moved to its open position and the conveyor 3 stops. The feed roller assembly 8 of the second machine is then moved to its closed position and the grip rolls 22 are moved by the grip mechanism 27 into their driving position. The already de-fleshed half of the hide extends from the cutter 25, between the grip rolls 22 and the feed roller 5, and on to the conveyor 3, and the feed roller 5, and the grip rolls 22 are driven to draw the hide up between the cutter 25 and the pressure roll 26, the cutter 25 being rotated to de-flesh the hide. When the hide is wholly de-fleshed, and lying on the transfer conveyor 3 between the two machines, the conveyor is again stopped by moving the feed roller assembly 8 of the second machine to its open position. The hide is then hung by its neck-end on one of a plurality of hooks 6*a* of the delivery conveyor 6 and transported away by the delivery conveyor for further processing.

While the hide has been de-fleshed in the second machine 21 a next hide has been delivered by the feed conveyor 1 to the first machine 11, and accordingly the feed roller assembly 7 can without delay be moved to its closed position for commencement of de-fleshing of the next hide.

Having thus described the invention, what we claim as new and desire to secure as Letters Patent of the United States is:

1. A machine for defleshing animal hides, comprising:

two de-fleshing machines arranged symmetrically back to back, each machine having a cutter roll and a feed roll and at least one pressure roll pressing the hide against the feed roll, whereby both de-fleshing machines are connected together by a conveyor belt which is movable in opposite directions, said conveyor belt being guided around the feed roll of one de-fleshing machine, and said conveyor belt is also guided around the feed roll of the second de-fleshing machine.

* * * * *

UNITED STATES PATENT OFFICE

CERTIFICATE OF CORRECTION

Patent No. 4,081,977 Dated April 4, 1978

Inventor(s) Alexander Schmidt, SR., et al.

It is certified that error appears in the above-identified patent and that said Letters Patent are hereby corrected as shown below:

On the Title Page, Item [73] should read:

--- Alexander Schmidt GmbH, Weiz Austria ---.

Signed and Sealed this

*Twelfth* Day of *September 1978*

[SEAL]

*Attest:*

RUTH C. MASON
*Attesting Officer*

DONALD W. BANNER
*Commissioner of Patents and Trademarks*